US007140713B2

(12) United States Patent
Kawakami

(10) Patent No.: US 7,140,713 B2
(45) Date of Patent: Nov. 28, 2006

(54) RECORDING APPARATUS AND COMMUNICATION METHOD

(75) Inventor: Kunio Kawakami, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 93 days.

(21) Appl. No.: 10/694,437

(22) Filed: Oct. 28, 2003

(65) Prior Publication Data

US 2004/0239706 A1 Dec. 2, 2004

(30) Foreign Application Priority Data

Oct. 28, 2002 (JP) ..... 2002-312399

(51) Int. Cl.
*B41J 29/393* (2006.01)

(52) U.S. Cl. ..... 347/19

(58) Field of Classification Search ..... 347/5, 347/7–9, 12–14, 19, 49, 86; 401/132; 399/12–13
See application file for complete search history.

(56) References Cited

U.S. PATENT DOCUMENTS

| | | | | |
|---|---|---|---|---|
| 5,929,760 | A | 7/1999 | Monahan | |
| 6,585,345 | B1 * | 7/2003 | Kosugi | 347/19 |
| 2002/0063760 | A1 * | 5/2002 | Dietl et al. | 347/86 |
| 2002/0135630 | A1 * | 9/2002 | Kosugi | 347/19 |
| 2002/0194064 | A1 * | 12/2002 | Parry et al. | 705/14 |
| 2003/0215280 | A1 * | 11/2003 | Hatasa et al. | 401/132 |

FOREIGN PATENT DOCUMENTS

| | | | |
|---|---|---|---|
| JP | 2000-148923 | A | 5/2000 |
| JP | 2001-147146 | A | 5/2001 |
| JP | 2001-521307 | A | 11/2001 |
| JP | 2002-127391 | A | 5/2002 |
| JP | 2002-127459 | A | 5/2002 |
| JP | 2002-182798 | A | 6/2002 |
| JP | 2002-002926 | A | 9/2002 |
| WO | WO 99/21144 | A1 | 4/1999 |
| WO | WO 00/16570 | | 3/2000 |
| WO | 2002-525932 | | 7/2001 |
| WO | WO 01/65712 | | 9/2001 |
| WO | WO 02/02337 | A1 | 1/2002 |

* cited by examiner

*Primary Examiner*—Hai Pham
(74) *Attorney, Agent, or Firm*—Sughrue Mion, PLLC

(57) ABSTRACT

The technique of the invention relieves the requirement of repeated positioning to a wireless communicable range in the process of data transmission to and from each of multiple cartridges by wireless communication.

A carriage 210 with multiple ink cartridges 111 through 116 mounted thereon is stopped at a position P1, which is away a distance D0 from an antenna 233 and is conveyed from the position P1 at a preset velocity V. With the movement of the carriage 210, detection storage modules 121 through 126 mounted on the ink cartridges 111 through 116 sequentially approach to the antenna 233 and establish communication with a control circuit 222 of a printer via the antenna 233 of a receiver transmitter unit 230. This arrangement enables data transmission between the control circuit 222 and each of the detection storage modules 121 through 126 without repeatedly stopping the carriage 210.

7 Claims, 10 Drawing Sheets

RECORDING APPARATUS AND COMMUNICATION METHOD

BACKGROUND OF THE INVENTION

1. Field of the Invention

The present invention relates to a communication technique with a cartridge having a recording material held therein. More specifically the invention pertains to a technique of establishing communication with such a cartridge by wireless.

2. Description of the Related Art

Diverse recording apparatuses have been used widely; for example, recording apparatuses (printers) that eject inks on printing paper to print images, such as ink jet printers, and recording apparatuses that utilize toners to print images. Each cartridge mounted on such a printer contains a recording material like ink or toner and has a memory for storing data regarding the recording material or a sensor for detecting the presence or the absence of the recording material. The technique of such printers is disclosed, for example, in PATENT LAID-OPEN GAZETTE No. 2001-147146.

The cartridge is required to transmit the detection result of the sensor and the storage contents of the memory to and from the printer. Recently proposed techniques utilize wireless communication for such data transmission. The printer stops each cartridge in front of a coil functioning as an antenna and establishes communication with the cartridge by means of electromagnetic induction or another technique.

The communicable range of the cartridge is often restricted in wireless communication. The stop position of the cartridge is thus required to be specified with high accuracy. The wider communicable range does not require the cartridge to be positioned with high accuracy relative to the antenna for wireless communication. The output of wireless communication for this purpose is, however, generally rather restricted and has a narrow communicable range. Extension of the communication range is not at all practical, since it may cause interferences of adjoining printers and releases unnecessary radio waves.

The issue of the accuracy of positioning in wireless communication is discussed with a concrete example. In a printer with multiple ink cartridges mounted thereon, each cartridge has a communication module and the distance between adjoining cartridges is about 13 millimeters. The responsive range of each communication module to an antenna provided on the printer is smaller than this distance (for example, 8 millimeters). In the actual state, the allowable positioning accuracy of a carriage with the multiple cartridges is only 1 or 2 millimeters by taking into account the dimensional tolerance of the location of the antenna and the variation in communicable range. It is not easy to stop the carriage of a certain weight with the multiple ink cartridges mounted thereon relative to the antenna with such a high positioning accuracy. The insufficiency in positioning accuracy or in communicable range may cause plural communication modules of plural ink cartridges to enter the range of wireless communication simultaneously. This requires identification of the target of communication (anti-collision process).

SUMMARY OF THE INVENTION

The recording apparatus of the invention aims to facilitate data transmission between a recording apparatus, such as a printer, and each of multiple cartridges attached to the recording apparatus by wireless communication.

In order to attain at least part of the above and the other related objects, the present invention is directed to a recording apparatus including multiple cartridges, which contain recording materials therein, and an apparatus communication module that establishes wireless communication with each of the multiple cartridges. Here each of the multiple cartridges has a cartridge communication module, which establishes wireless communication with the apparatus communication module and possesses intrinsic information for identification of each of the multiple cartridges in wireless communication.

The recording apparatus further includes: a transportation module that is capable of collectively transporting the multiple cartridges and sequentially makes the cartridge communication modules mounted on the multiple cartridges approach to and pass by an antenna, which is provided for the wireless communication; and an access module that, when the cartridge communication module mounted on any one of the multiple cartridges enters a communicable range of the apparatus communication module via the antenna and establishes communication with the apparatus communication module, identifies the one of the multiple cartridges based on the intrinsic information possessed by the one of the multiple cartridges and transmits predetermined data to or from the identified cartridge.

In the recording apparatus of the invention, the transportation module collectively transports the multiple cartridges and sequentially makes the cartridge communication modules mounted on the multiple cartridges approach to and pass by the antenna, which is provided for the wireless communication. The cartridge communication modules of the multiple cartridges thus sequentially enter a communicable range with the apparatus communication module of the recording apparatus. The access module establishes communication with each of the multiple cartridge communication modules to identify the one of the multiple cartridges based on the intrinsic information possessed by the one of the multiple cartridges and transmit predetermined data to or from the identified cartridge. The recording apparatus of the invention accordingly relives the requirement of accurate repeated positioning of the multiple cartridges for wireless communication. As the cartridges are conveyed, wireless communication is sequentially established between the recording apparatus and the cartridge communication modules mounted on the multiple cartridges. This arrangement desirably shortens the total time required for communication, compared with the prior art structure that establishes communication with repeated movement and stop of the cartridges.

One preferable embodiment of the recording apparatus includes a carriage with the multiple cartridges mounted thereon, and a conveyance mechanism that conveys the carriage for recording on a recording medium with the recording materials. In this embodiment, the conveyance mechanism works to sequentially make the cartridge communication modules mounted on the multiple cartridges approach to and pass by the antenna. In this structure, the conveyance mechanism for recording is usable for conveyance of the cartridge for wireless communication.

Conveyance of the cartridges for wireless communication may be out of a recording range onto the recording medium. Communication out of the conveyance range for recording desirably enhances the degree of freedom in arrangement of the antenna for communication. Communication may otherwise be established in the conveyance range for recording.

This arrangement does not require conveyance out of the recording range and thereby restricts the conveyance range of the cartridges.

It is preferable that the multiple cartridges are transported for wireless communication at a specific moving velocity, which is set corresponding to an interval between each adjoining pair of the multiple cartridges to ensure a time period required for identification of each of the multiple cartridges and a time period required for transmission of the predetermined data.

In one preferable application of the recording apparatus, the cartridge communication module included in each of the multiple cartridges utilizes electromagnetic induction for transmission of the predetermined data and receives at least part of electric power consumed by the cartridge. In this preferable arrangement, the cartridge is not required to have any power source, such as a cell or battery.

In one preferable structure of the recording apparatus, each of the multiple cartridges has an ink chamber containing one of multiple color inks as the recording material. The multiple color inks may be four color inks, yellow, magenta, cyan, and black or may be six color inks, yellow, magenta, cyan, black as well as light cyan and light magenta having lower dye concentrations than cyan and magenta.

The predetermined data transmitted between each of the multiple cartridges and the recording apparatus may be data regarding the recording materials contained in the multiple cartridges. Typical examples of such data include the presence or the absence of the recording material, the residual quantity, the viscosity, and the temperature of the recording material, and the date and time of its use.

Another application of the invention is a method of establishing communication with a cartridge.

The invention is directed to a communication method of establishing wireless communication between each of multiple cartridges containing recording materials and a recording apparatus with the multiple cartridges attached thereto. The communication method includes the steps of: providing each of the multiple cartridges which mounts a cartridge communication module and establishes wireless communication and possesses intrinsic information for identification of each of the multiple cartridges in wireless communication; collectively transporting the multiple cartridges and sequentially making the cartridge communication modules mounted on the multiple cartridges approach to and pass by an antenna, which is provided for the wireless communication; when the cartridge communication module mounted on any one of the multiple cartridges enters a communicable range via the antenna and establishes wireless communication, identifying the one of the multiple cartridges based on the intrinsic information possessed by the one of the multiple cartridges; and transmitting predetermined data to or from the identified cartridge.

This communication method relives the requirement of accurate repeated positioning of the multiple cartridges for wireless communication. As the cartridges are conveyed, wireless communication is sequentially established between the recording apparatus and the cartridge communication modules mounted on the multiple cartridges. This arrangement desirably shortens the total time required for communication, compared with the prior art structure that establishes communication with repeated movement and stop of the cartridges.

DESCRIPTION OF THE PREFERRED EMBODIMENTS

Figure 1:
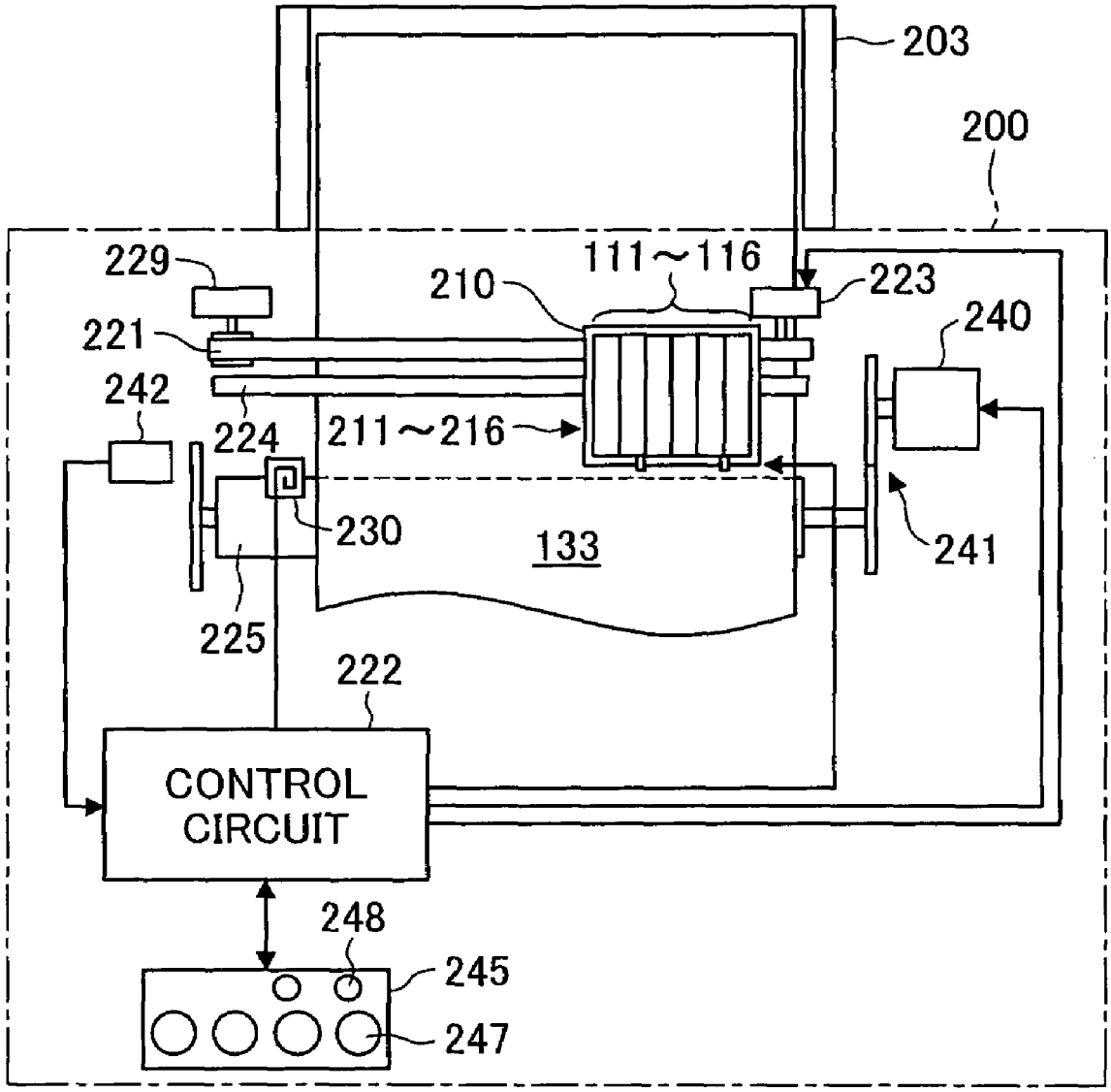
FIG. 1 schematically illustrates the internal structure of a printer 200 in one embodiment of the invention.
Figure 2:
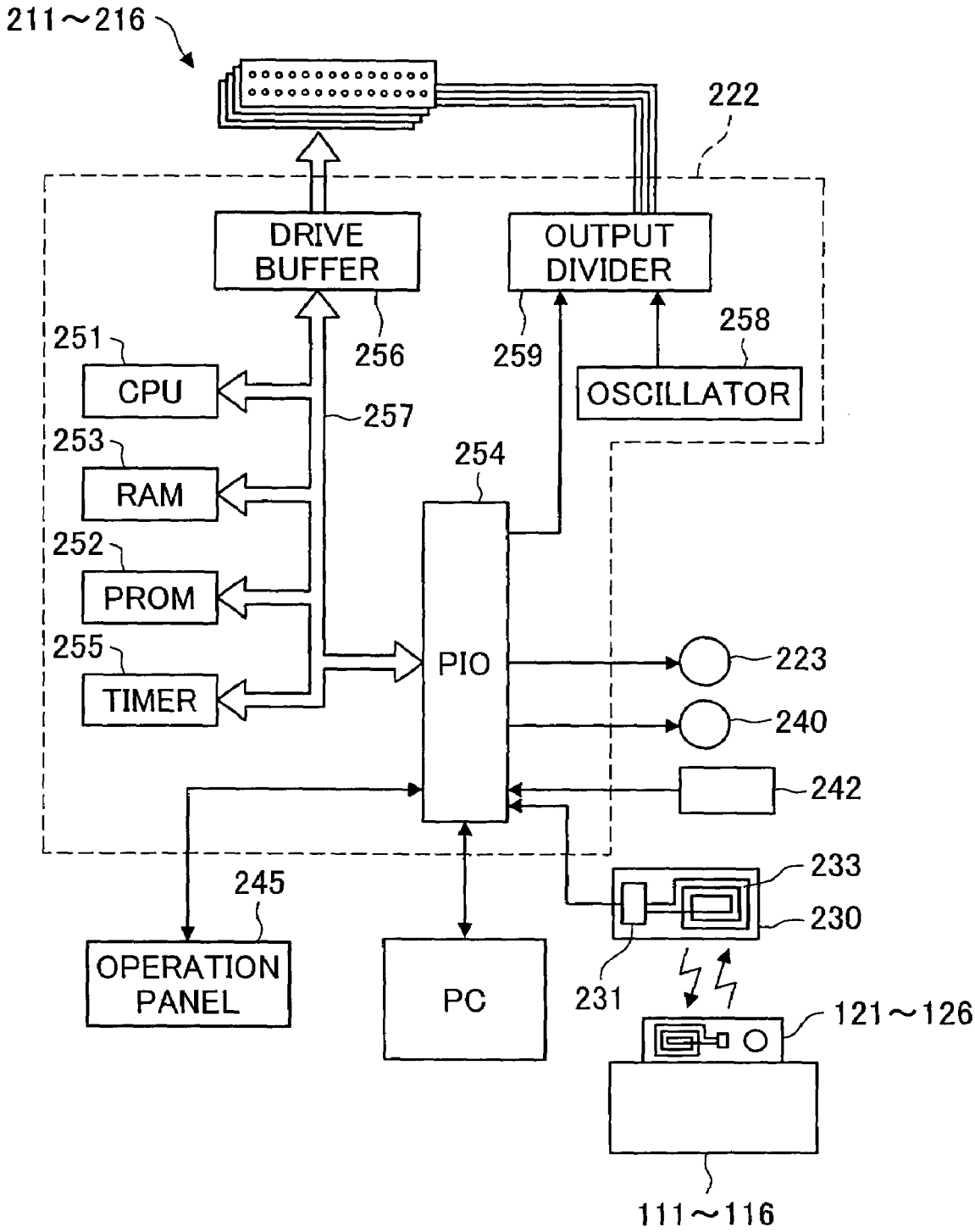
FIG. 2 is a block diagram showing the internal structure of a control circuit 222 included in the printer 200 of the embodiment.

One mode of carrying out the invention is discussed below. A first embodiment regards application of the invention to an inkjet printer. FIG. 1 schematically illustrates the configuration of a printer 200 with a focus on its operation-relating part. FIG. 2 shows the electrical construction of a control circuit 222 included in the printer 200. As shown in FIG. 1, the printer 200 activates print heads 211 through 216 to eject ink droplets and form an image on a sheet of printing paper T, which is fed from a paper feeder unit 203 and is conveyed by means of a platen 225. The platen 225 is actuated and rotated by the driving force transmitted from a paper feed motor 240 via a gear train 241. The rotation angle of the platen 225 is measured by an encoder 242. The print heads 211 through 216 are mounted on a carriage 210, which moves back and forth along the width of the printing paper T. The carriage 210 is linked with a conveyor belt 221, which is actuated by a stepping motor 223. The conveyor belt 221 is an endless belt and is spanned between the stepping motor 223 and a pulley 229 arranged on the opposite side. With rotations of the stepping motor 223, the conveyor belt 221 moves to reciprocate the carriage 210 along a conveyor guide 224.

Ink cartridges 111 through 116 of six different colors are mounted on the carriage 210. The six color ink cartridges 111 through 116 basically have an identical structure but contain inks of different compositions, that is, inks of different colors, in their internal ink chambers. More specifically, the ink cartridges 111 through 116 respectively contain black ink (K), cyan ink (C), magenta ink (M), yellow ink (Y), light cyan ink (LC), and light magenta ink (LM). The light cyan ink (LC) and the light magenta ink (LM) are lighter in color than and have approximately ¼ of the dye concentrations of the cyan ink (C) and the magenta ink (M). The ink cartridges 111 through 116 respectively have detection storage modules 121 through 126, which will be described later in detail. The detection storage modules 121 through 126 transmit data to and from a control circuit 222 of the printer 200 by wireless communication. In the structure of the first embodiment, the detection storage modules 121 through 126 are attached to the respective side faces of the ink cartridges 111 through 116.

The printer 200 has a receiver transmitter unit 230 to establish wireless communication and data exchange with these detection storage modules 121 through 126. The receiver transmitter unit 230, as well as the paper feed motor 240, the stepping motor 223, the encoder 242, and the other electronic components are connected to the control circuit 222. Diverse switches 247 and LEDs 248 on an operation panel 245 provided on the front face of the printer 200 are also connected with the control circuit 222.

Referring to FIG. 2, the control circuit 222 includes a CPU 251 that controls the operations of the whole printer 200, a ROM 252 that stores control programs therein, a RAM 253 that is used for temporary storage of data, a PIO 254 that functions as interfaces with external devices, a timer 255 that manages the time, and a drive buffer 256 that stores data for actuation of the print heads 211 through 216. These circuit elements are mutually connected via a bus 257. The control circuit 222 also includes an oscillator 258 and an output divider 259. The output divider 259 distributes pulse signals output from the oscillator 258 into common terminals of the six print heads 211 through 216. The print heads 211 through 216 receive on-off data (representing ink ejection state and non-ejection state) from the drive buffer 256 and activate corresponding nozzles to eject ink according to the on-off data from the drive buffer 256 in response to reception of drive pulses from the output divider 259.

The PIO 254 of the control circuit 222 is connected with a computer PC that outputs image data as objects to be printed to the printer 200, as well as with the stepping motor 223, the paper feed motor 240, the encoder 242, the receiver transmitter unit 230, and the operation panel 245. The computer PC specifies an object image to be printed, makes data of the object image subjected to required series of processing, such as rasterizing, color conversion, and half toning, and outputs resulting processed image data to the printer 200 for printing. The printer 200 determines the moving position of the carriage 210 based on the actuation amount of the stepping motor 223, while checking the paper feed position based on the data from the encoder 242. The printer 200 expands the processed data output from the computer PC into ink on-off data representing ink ejection or non-ejection from nozzles of the print heads 211 through 216 and actuates the drive buffer 256 and the output divider 259.

The control circuit 222 transmits data by wireless to and from the detection storage modules 121 through 126 attached to the ink cartridges 111 through 116 via the receiver transmitter unit 230 connecting with the PIO 254. For this purpose, the receiver transmitter unit 230 has an RF conversion element 231 that converts signals from the PIO 254 into alternating current (AC) signals of a fixed frequency, and a loop antenna 233 that receives the AC signals from the RF conversion element 231. When the loop antenna 233 receives the AC signal, the electromagnetic induction excites an electric signal in another antenna located close to the loop antenna 233. The distance of wireless communication is restricted to the internal distance of the printer, so that the electromagnetic induction-based wireless communication technique is adopted in the structure of this embodiment. In the structure of this embodiment both the transmitting side and the receiving side of wireless communication provide only one antenna commonly used for transmission and reception. In one modified structure, two antennas may be provided to be used exclusively for transmission and reception on at least one of the transmitting side and the receiving side. The structure of this embodiment gains the working power of the cartridges by the electromagnetic induction between the antennas used for communication. An antenna exclusively used for power supply may be provided separately.

Figure 3A:
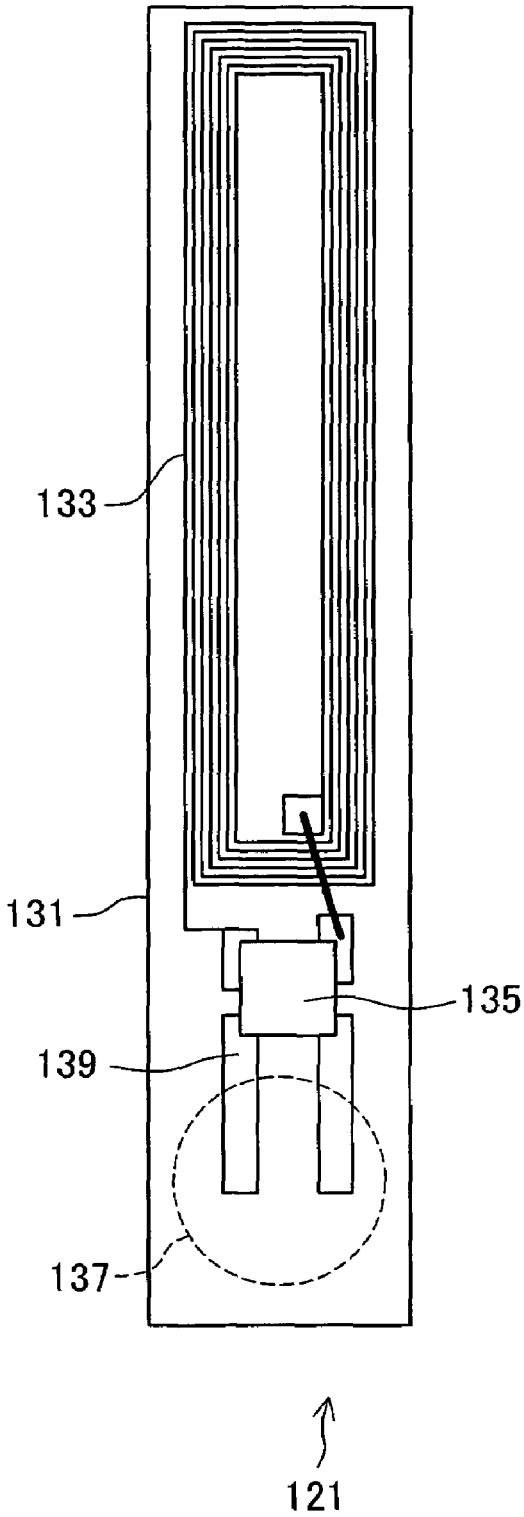
FIGS. 3(A) and 3(B) show the appearance of a detection storage module 121 used in the embodiment.
Figure 3B:
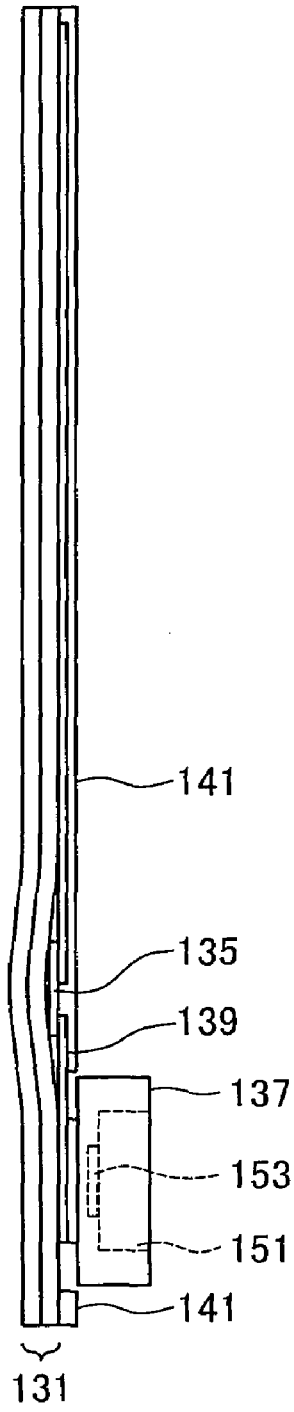

The following describes the structure of the detection storage module 121 attached to the ink cartridge 111. FIGS. 3(A) and 3(B) are a front view and a side view showing the appearance of the detection storage modules 121 through 126. The detection storage modules 121 through 126 mounted on the respective ink cartridges 111 through 116 have an identical structure, except ID numbers stored therein. The description accordingly regards the detection storage module 121 as an example. As shown in FIG. 3(B), the detection storage module 121 has a four-layered structure. For convenience, each layer has a distinct thickness in the illustration, although the thickness of each layer is actually only several tens microns. The four layers of the detection storage module 121 are a laminate layer, a circuit base layer of PET, a wiring layer of copper foil, and an adhesive layer from the opposite side of a sensor module 137. The laminate layer with a print and the circuit base layer constitute a substrate 131. The wiring layer is actually not formed over the whole surface of the substrate 131 but is formed corresponding to a required pattern including an antenna 133 and a wiring pattern 139 for wiring with a semiconductor element (discussed later) and the sensor module 137. FIG. 3(A) shows the antenna 133 and the wiring pattern 139 through the substrate 131 for the better understanding. The adhesive layer located below the wiring layer is actualized by application of an adhesive agent 141 and covers over the antenna 133 and an exclusive IC chip 135 of the semiconductor element having various built-in functions. In other words, the adhesive layer is not formed to cover over the wiring pattern 139 for wiring with the sensor module 137. The sensor module 137 is thus directly connected with the wiring pattern 139. Release coated paper covering over the adhesive layer is peeled off, when the detection storage module 121 is attached to the ink cartridge 111. The exclusive IC chip 135 is located between the wiring pattern 139 and the substrate 131. The IC chip 135 has a thickness of several tens microns and thus only slightly expands the substrate 131 including the laminate layer and the PET circuit base layer. The exclusive IC chip 135 is effectively received in the detection storage module 121 in this manner.

Figure 4:
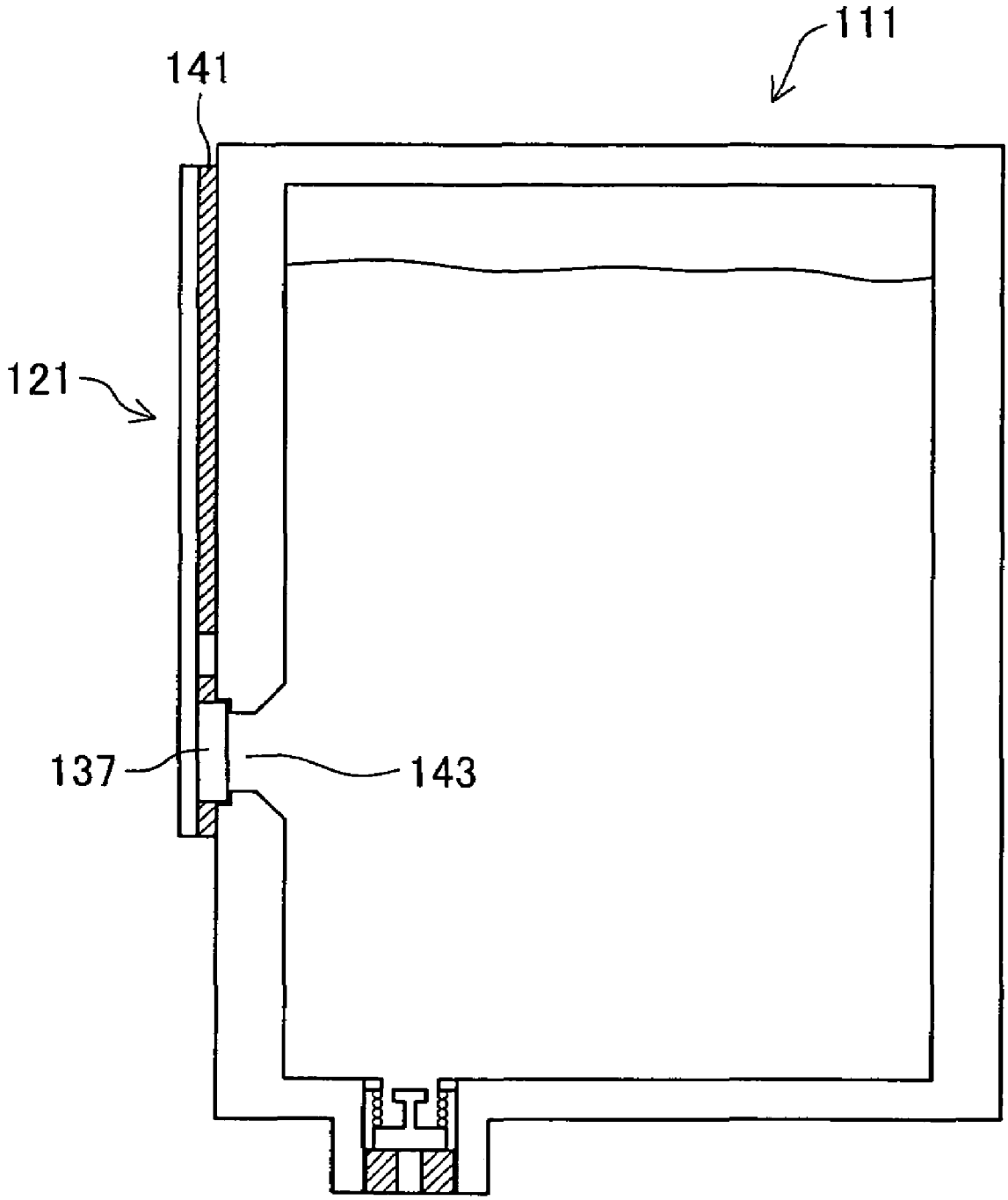
FIG. 4 shows attachment of the detection storage module 121 to an ink cartridge 111 in the embodiment.

FIG. 4 is an end view showing attachment of the detection storage module 121 to the ink cartridge 111. Release coated paper (not shown) covering over an adhesive layer 141 is peeled off, and the detection storage module 121 is attached to the side face of the ink cartridge 111 via the adhesive layer 141. The sensor module 137 located on the rear face of the substrate 131 is fit in an opening 143 formed in the side face of the ink cartridge 111 in the process of attachment of the detection storage module 121. The sensor module 137 includes a cavity 151 and a piezoelectric element 153, which is set on one side wall of the cavity 151 and functions as a sensor.

Figure 5:
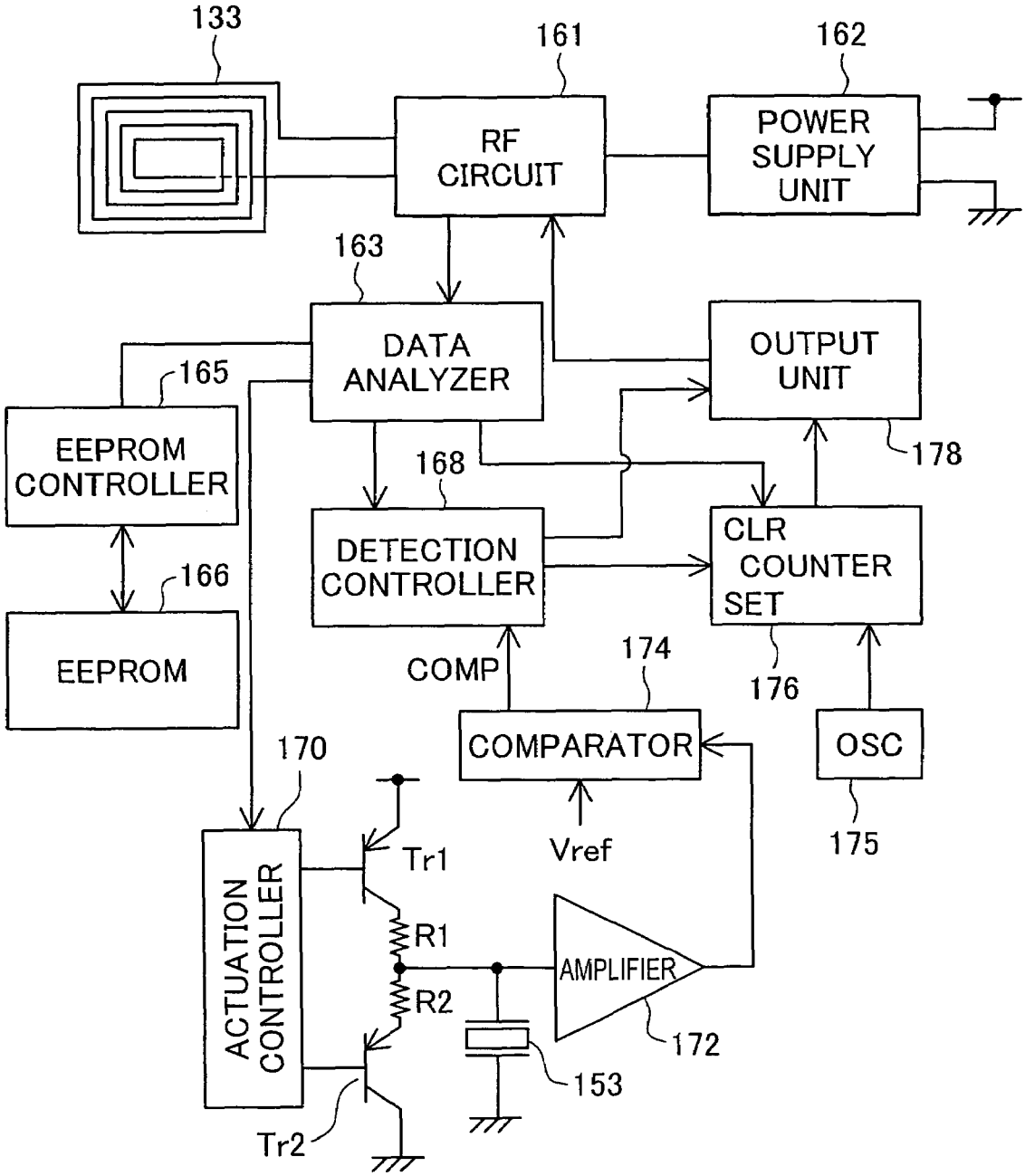
FIG. 5 is a block diagram showing the internal structure of the detection storage module 121.

The internal structure of the detection storage module 121 is described. FIG. 5 is a block diagram showing the internal structure of the detection storage module 121. As illustrated, the detection storage module 121 has an RF circuit 161, a power supply unit 162, a data analyzer 163, an EEPROM controller 165, an EEPROM 166, a detection controller 168, an actuation controller 170, an amplifier 172, a comparator 174, an oscillator 175, a counter 176, an output unit 178, two transistors Tr1 and Tr2, and two resistors R1 and R2, which are also incorporated in the exclusive IC chip 135.

The RF circuit 161 demodulates an AC signal generated in the antenna 133 by the electromagnetic induction, extracts an electric power component and a signal component from the demodulated AC signal, and outputs the electric power component to the power supply unit 162 while outputting the signal component to the data analyzer 163. The RF circuit 161 also functions to receive a signal from the output unit 178 (described later), modulates the received signal to an AC signal, and transmits the modulated AC signal to the receiver transmitter unit 230 of the printer 200 via the antenna 133. The power supply unit 162 receives the electric power component from the RF circuit 161, stabilizes the received electric power component, and outputs the stabilized electric power component as the power source of the exclusive IC chip 135 and the sensor module 137.

Figure 6A:
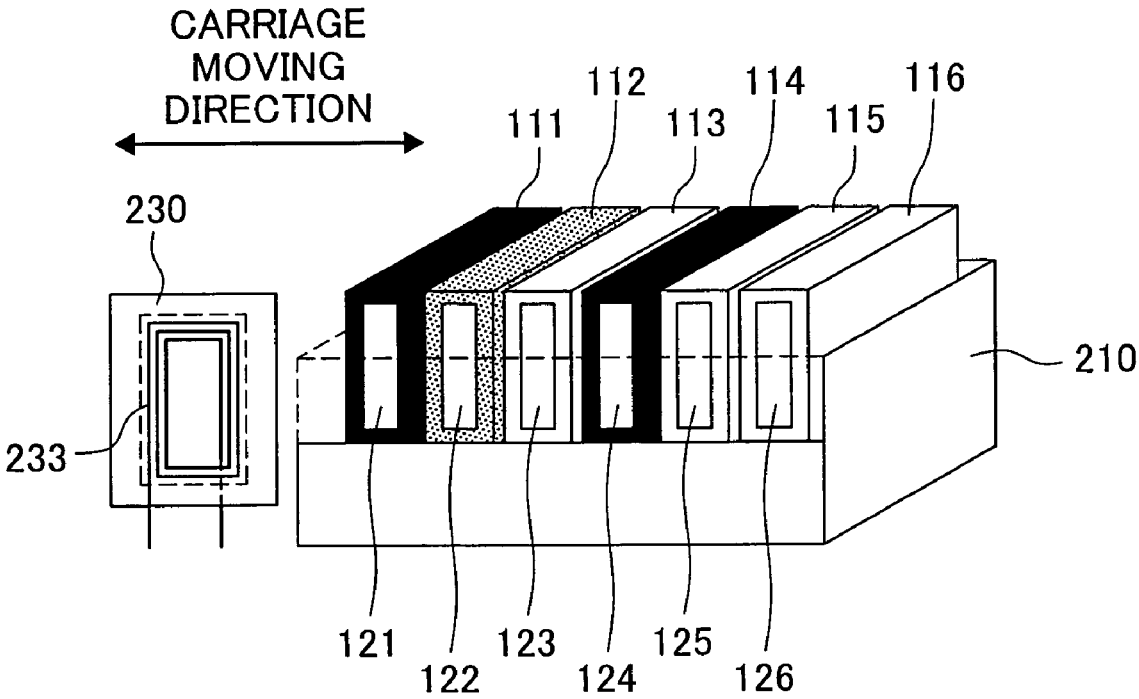
FIGS. 6(A) and 6(B) show the positions of ink cartridges 111 through 116 mounted on a carriage 210 relative to a receiver transmitter unit 230.
Figure 6B:
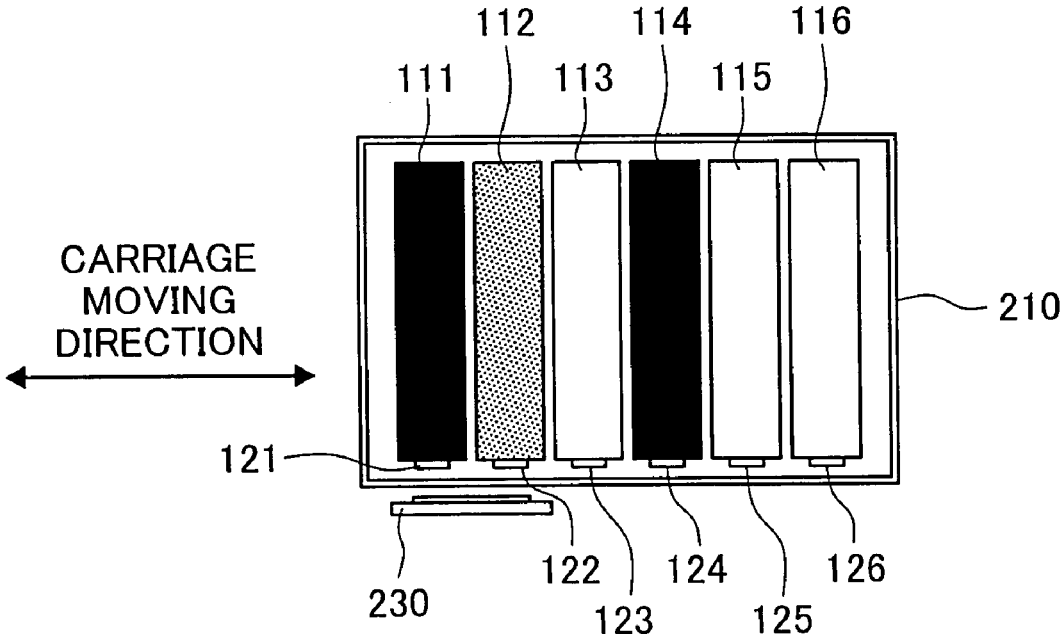

The data analyzer 163 analyzes the signal component received from the RF circuit 161 and extracts a command and data from the analyzed signal component. The data analyzer 163 controls selection of either data transmission to and from the EEPROM 166 or data transmission to and from the sensor module 137, based on the result of the data analysis. The data analyzer 163 also identifies an object ink cartridge for the data transmission to and from the EEPROM 166 or for the data transmission to and from the sensor module 137. The details of the identification process will be discussed later, but basically the identification process identifies the object ink cartridge, based on information with regard to the positions of the respective ink cartridges mounted on the carriage 210 relative to the receiver transmitter unit 230 as shown in FIGS. 6(A) and 6(B) and the IDs stored in the respective ink cartridges. FIG. 6(A) is a perspective view showing the positions of the ink cartridges 111 through 116 with the detection storage modules 121 through 126 attached thereto relative to the receiver transmitter unit 230. FIG. 6(B) shows the relative widths of the ink cartridges 111 through 116 and the receiver transmitter unit 230.

For identification of the object ink cartridge, the control circuit 222 shifts the carriage 210 to approach to the receiver transmitter unit 230. The position of the carriage 210 facing the receiver transmitter unit 230 is outside a printable range. As shown in FIGS. 6(A) and 6(B), the detection storage modules 121 through 126 are attached to the side faces of the respective ink cartridges 111 through 116 in the structure of this embodiment. The shift of the carriage 210 causes two detection storage modules at the maximum to enter a transmittable range of the receiver transmitter unit 230. In this state, the data analyzer 163 receives a request from the control circuit 222 via the receiver transmitter unit 230 and performs identification of the object ink cartridge and subsequent data transmission to and from the EEPROM 166 or the sensor module 137. The details of the processing will be discussed later with reference to flowcharts.

In the process of actual data transmission to and from the EEPROM 166 after identification of the object ink cartridge for the data transmission, the data analyzer 163 transfers a specified address for a reading operation or a writing operation, specification of the reading/writing operation, that is, selection of either the reading operation or the writing operation, and data to be written in the case of the writing operation to the EEPROM controller 165. The EEPROM controller 165 receives the specifications and the data and outputs the specified address and the specification of the reading/writing operation to the EEPROM 166. The EEPROM controller 165 accordingly reads the existing data from the specified address of the EEPROM 166 or writes the received data into the specified address of the EEPROM 166.

Figure 7A:
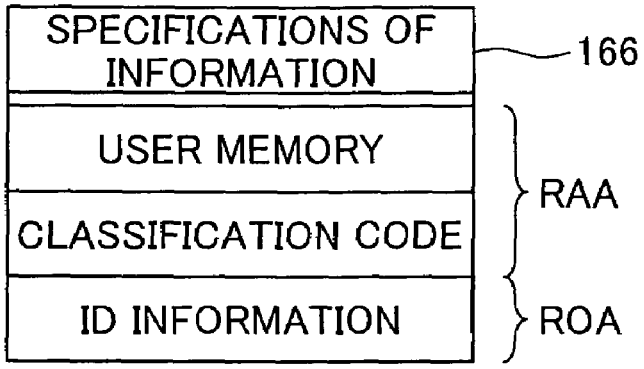
FIGS. 7(A) and 7(B) show information stored in the detection storage module 121 and in an EEPROM 166.
Figure 7B:
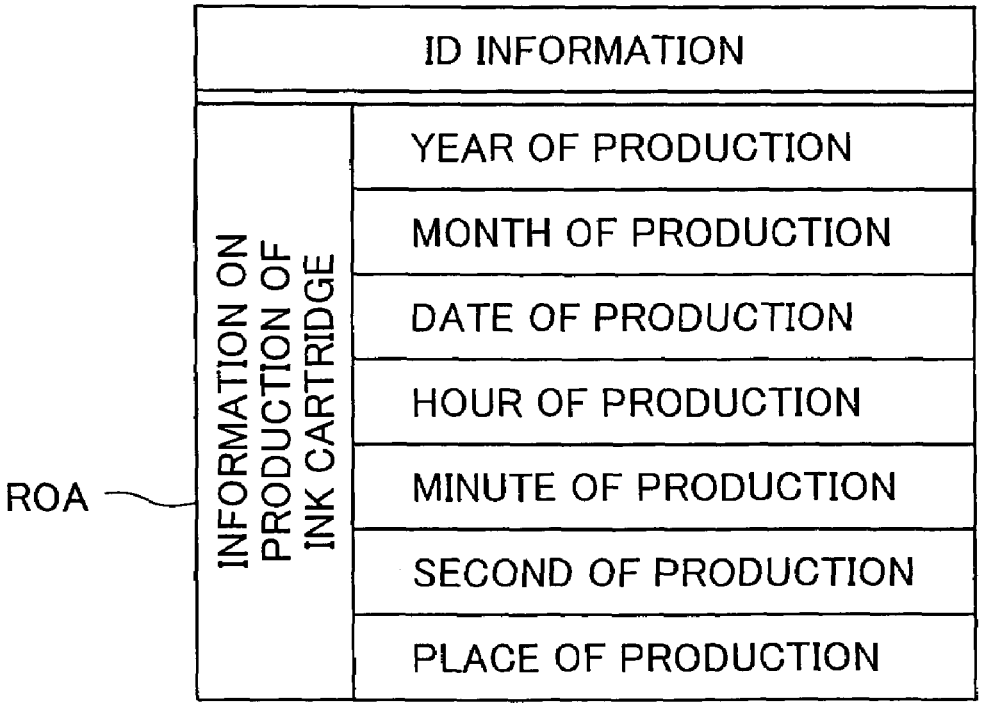

The internal data structure of the EEPROM 166 is shown in FIGS. 7(A) and 7(B). The memory space of the EEPROM 166 is roughly divided into two sections as shown in FIG. 7(A). The former section of the memory space is a readable and writable area RAA including a classification code field and a user memory field, which data like the residual quantity of ink are read from and written in. The latter section of the memory space is a read only area ROA which ID information for identifying the ink cartridge is written in.

The ID information is written into the read only area ROA prior to attachment of each of the detection storage modules 121 through 126 including the EEPROM 166 to the corresponding ink cartridge 111 through 116, for example, in the manufacturing process of the detection storage modules or in the manufacturing process of the ink cartridges. The printer 200 is allowed to read data from the readable writable area RAA and write data into the readable writable area RAA. The printer 200 is, however, not allowed to write data into the read only area ROA, while being allowed to read data from the read only area ROA.

The user memory field of the readable writable area RAA is used to write information regarding the residual quantity of ink in the corresponding one of the ink cartridges 111 through 116. The printer 200 reads the information on the residual quantity of ink and may give an alarm to the user when the residual quantity of ink is below a preset level. The classification code field stores various codes for distinction of the corresponding ink cartridge. The user may use these codes according to the requirements.

The ID information stored in the read only area ROA includes production information with regard to the corresponding ink cartridge, to which the detection storage module is attached. A typical example of the ID information regards the year, the month, the date, the hour, the minute, the second, and the place of production of the corresponding one of the ink cartridges 111 through 116 as shown in FIG. 7(B). Each piece of the ID information requires a memory area of 4 to 8 bits, so that the ID information totally occupies a memory area of 40 to 70 bits. Immediately after each power supply to the printer 200, for example, the control circuit 222 of the printer 200 may read the ID information including the production information of the ink cartridges 111 through 116 from the respective detection storage modules 121 through 126 and give an alarm to the user when any of the ink cartridges has expired or will expire soon.

Adequate pieces of information other than the information discussed above may also be stored in the EEPROM 166 of the detection storage module 121. The whole area of the EEPROM 166 may be constructed as a readable and writable area. In this case, an electrically readable and writable memory, such as a NAND flash ROM, may be applied for the EEPROM 166 to store the ID information like the production information of the ink cartridge. In the structure of this embodiment, a serial-type memory is applied for the EEPROM 166.

In the case of data transmission to and from the sensor module 137, the data analyzer 163 clears the counter 176, receives a detection condition from the control circuit 222, and sets the received detection condition in the detection controller 168. The detection controller 168 specifies a detection period defined by a preset measurement starting pulse in a signal output from the piezoelectric element 153 of the sensor module 137 and a specified number of pulses, according to the setting of the detection condition. The data analyzer 163 subsequently instructs the actuation controller 170 to output driving signals. The actuation controller 170 outputs driving signals to the transistors Tr1 and Tr2 and applies a driving voltage to the piezoelectric element 153, in response to this instruction. The resonance arising in the piezoelectric element 153 due to application of the driving voltage is amplified by the amplifier 172 and is input into the comparator 174 to be converted into a rectangular pulse signal. The comparator 174 compares the output signal from the amplifier 172 with a predetermined reference voltage Vref and converts the output signal into a rectangular pulse signal, based on results of the comparison.

The detection controller 168 receives the signal from the comparator 174 and sets a SET terminal of the counter 176 active to actuate the counter 176 for duration of the specified number of pulses from the preset measurement starting pulse. The counter 176 counts the pulses output from the oscillator 175 in the active state of the SET terminal, and outputs a resulting count to the output unit 178. The output unit 178 receives the value of the detection condition from the detection controller 168 and outputs the resulting count received from the counter 176 and the value of the detection condition to the control circuit 222 via the RF circuit 161. Here the value of the detection condition is a total of an ordinal pulse number corresponding to the preset measurement starting pulse and the specified number of pulses, that is, an ordinal pulse number corresponding to a measurement termination pulse (for example, the $5^{th}$ pulse). The ordinal pulse number corresponding to the preset measurement starting pulse and the specified number of pulses may be used for the values of the detection condition. The output unit 178 maybe built in the data analyzer 163.

Figure 8:
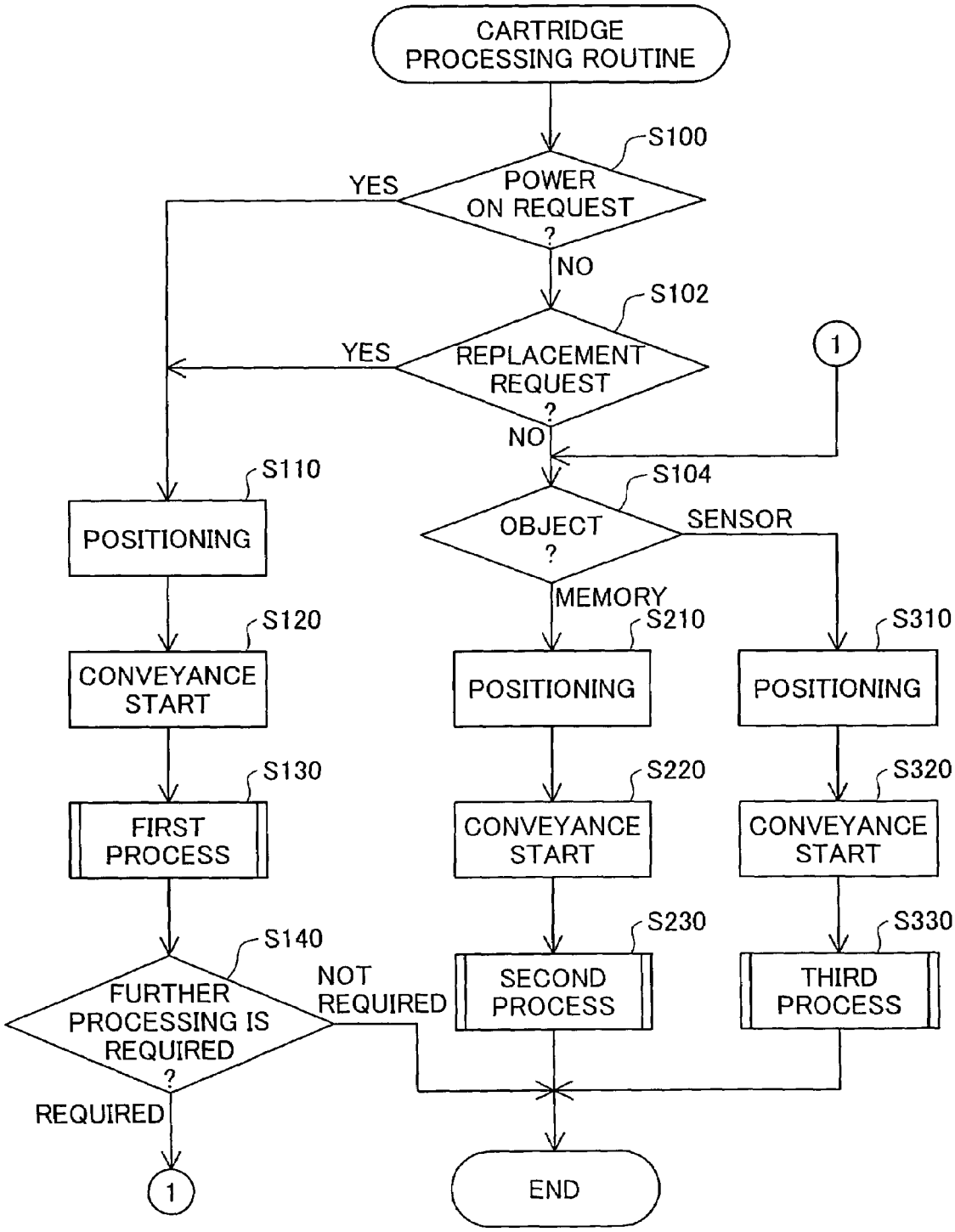
FIG. 8 is a flowchart showing a cartridge processing routine executed by the control circuit 222.

The control circuit 222 of the printer 200, in cooperation with the data analyzer 163 included in each of the detection storage modules 121 through 126, identifies the object ink cartridge and subsequently gains access to the memory or the sensor. FIG. 8 is a flowchart showing a series of processing executed by the control circuit 222 of the printer 200, in cooperation with the detection storage modules 121 to 126 of the ink cartridges 111 to 116, through communication via the receiver transmitter unit 230. The control circuit 222 of the printer 200 and the data analyzer 163 included in each of the detection storage modules 121 through 126 establish communication via the receiver transmitter unit 230 and carry out an ID information reading process (first process), a memory access process (second process) to read information other than the ID information and to write information on the remaining quantity of ink, and a sensor access process (third process) to transmit data to and from the sensor module 137.

At the time of each power supply to the printer 200, in the case of the user's replacement of any of the ink cartridges 111 through 116 in the power ON condition, or after elapse of a preset time since previous execution of communication, the printer 200 reads the production information of each ink cartridge and writes and reads the residual quantity of ink into and from a predetermined field in the EEPROM 166. Unlike the general printing process, this series of processing requires communication with each of the detection storage modules 121 through 126 via the receiver transmitter unit 230.

The control circuit 222 first determines whether a power ON request has just been output (step S100) This step determines whether power has just been supplied to the inkjet printer 200 to start its operations. When it is determined that the power ON request has just been output (step S100: Yes), the control circuit 222 carries out the processing of and after step S110 to obtain intrinsic information with regard to each of the ink cartridges 111 through 116 attached to the printer 200 (that is, the processing prior to execution of the first process). When it is determined that no power ON request has just been output (step S100: No), on the other hand, the control circuit 222 determines that the printer 200 is carrying out a general printing process and subsequently determines whether a replacement request for any of the ink cartridges 111 through 116 has just been output (step S102). The replacement request for any of the ink cartridges 111 through 116 is output, for example, when the user presses an ink cartridge replacement button 247 on the operation panel 245 in the power ON state of the printer 200. In response to a press of the ink cartridge replacement button 247, the printer 200 stops the general printing process to allow for replacement of any of the ink cartridges 111 through 116. The replacement request is output after actual replacement of any of the ink cartridges 111 through 116.

When it is determined that the replacement request for any of the ink cartridges 111 through 116 has just been output (step S102: Yes), the control circuit 222 carries out the processing of and after step S110, that is, the processing prior to execution of the first process, to obtain intrinsic information from a newly attached ink cartridge. When neither the power ON request nor the replacement request for any of the ink cartridges has just been output (step S102: No), the control circuit 222 specifies the object of access, either the memory or the sensor (step S104). When the object of access is the memory, the control circuit 222 carries out the processing of and after step S210, that is, the processing prior to execution of the second process to transmit data to and from the memory. When the object of access is the sensor, the control circuit 222 carries out the processing of and after step S310, that is, the processing prior to execution of the third process to activate the sensor and obtain a result of detection. All the processing flows prior to the first through the third processes execute identical 'positioning' step (steps S110, S210, and S310) and 'conveyance start' step (steps S120, S220, and S320).

Figure 9A:
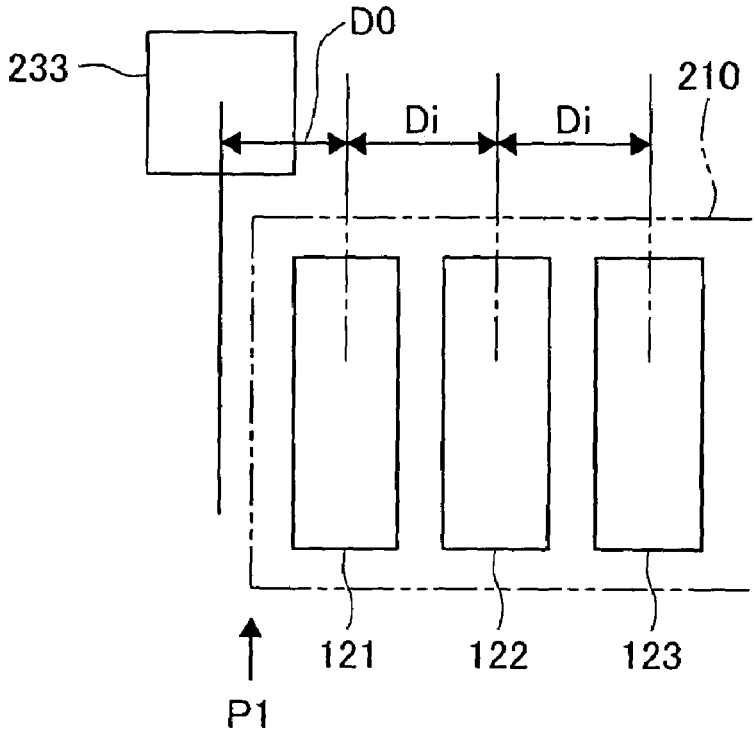
FIGS. 9(A) and 9(B) show the moving position of ink cartridges relative to an antenna 233.
Figure 9B:
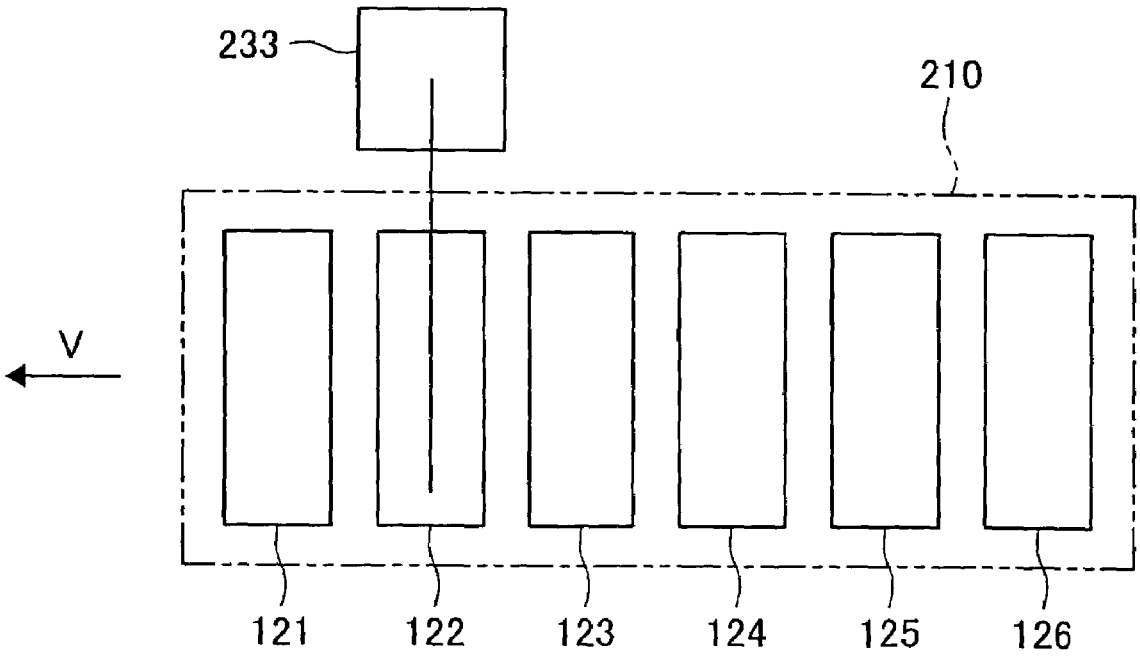

The positioning step (steps S110, S210, and S310) locates the carriage 210 with the ink cartridges mounted thereon at a preset position relative to the receiver transmitter unit 230 with the antenna 233 as shown in FIGS. 9(A) and 9(B). The procedure of this embodiment stops the carriage 210 at a position P1, which is away a distance D0 from the antenna 233. The distance D0 is determined by adding a margin of 2 mm to a design distance D, at which the ink cartridge 111 arranged on the head of the carriage 210 in the moving direction enters a communicable range of the antenna 233. One applicable method to position the carriage 210 uses a positioning sensor (a proximity switch) and conveys the carriage 210 to an ON position of the proximity switch. Another applicable method drives the stepping motor 233 to convey the carriage 210 and detects the moving position of the carriage 210 by open-loop control.

The control circuit 222 then starts conveying the carriage 210 from the position P1 (steps S120, S220, and S320). The higher moving velocity of the carriage 210 is desirable, as long as a travel time of the carriage 210 to a communicable position with a next ink cartridge is not less than a time period required for communication with a current ink cartridge. On the assumption that an interval Di [millimeter] between adjacent ink cartridges is fixed and that a maximum processing time for each of the first through the third processes is Tp [second], a moving velocity V [millimeter/second] of the carriage 210 is determined to satisfy a relation of:

$$V<Di/Tp \quad (1)$$

As the carriage 210 starts moving from the position P1 shown in FIG. 9(A), the detection storage module 121 attached to the ink cartridge 111 arranged on the head of the carriage 210 in the moving direction first approaches to the antenna 233 and establishes communication with the control circuit 222 via the receiver transmitter unit 230. Each detection storage module proximate to the receiver transmitter unit 230 receives the AC signal via the antenna 133 from the antenna 233 of the receiver transmitter 230. The power supply unit 162 extracts the electric power from the received AC signal and supplies the stabilized power source voltage to the internal controllers and circuit elements. The respective controllers and circuit elements included in the detection storage module thus receive the power to execute the series of processing.

When the power ON request has just been output, the control circuit 222 carries out the first process (step S130). When the first process has already been completed to read the ID information as the intrinsic information to each of the detection storage modules 121 through 126, the control circuit 222 specifies the object of access (step S104) and carries out either the second process (step S230) to access the memory or the third process (step S330) to access the sensor. On completion of the first process (step S130), it is determined whether further processing is required (step S140). When not necessary, the program exits from this cartridge processing routine. When another access to either the memory or the sensor is required, on the other hand, the program returns to step S104 to repeat the above series of processing.

Any of the first through the third processes is carried out, while the carriage 210 is conveyed at the velocity V. As shown by Relation (1) given above, the moving velocity V is set corresponding to the distance between adjoining ink cartridges to ensure the sufficient time period Tp for execution of any one of the first through the third processes. The head ink cartridge 111 approaches to the antenna 233, and the control circuit 222 establishes communication with the detection storage module 121. The control circuit 222 executes a predetermined process, for example, the first process, through communication with the detection storage module 121. On completion of the first process, the control circuit 222 waits for some time and then establishes communication with the next detection storage module 122. With the movement of the carriage 210, the same series of processing is repeated until the processing of the detection storage module 126 mounted on the last ink cartridge 116 is completed.

Prior to execution of the first process, the ID information as the intrinsic information to each of the detection storage modules 121 through 126 has not yet been read by the control circuit 222. In some state of communication, two detection storage modules (for example, the modules 121 and 122) may simultaneously respond to the communication from the control circuit 222. The procedure of this embodiment accordingly carries out anti-collision processing, obtains the ID information intrinsic to the detection storage module, and gains access to the memory or the sensor. The second process or the third process issues an active command to identify the target of communication, prior to the actual memory or sensor access. This arrangement effectively prevents interferences, even when two or more detection storage modules enter the communicable range with the movement of the carriage.

On completion of one of the first through the third processes with regard to all the ink cartridges 111 through 116 mounted on the carriage 210, the control circuit 222 terminates the processing routine of FIG. 8 and stops the carriage 210.

Figure 10A:
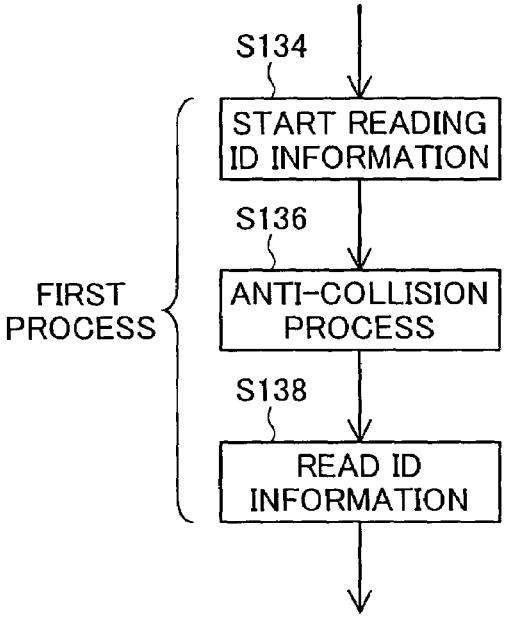
FIGS. 10(A), 10(B), and 10(C) are flowcharts showing the first process, the second process, and the third process in the flowchart of FIG. 8.

The details of the first through the third processes are discussed below. The details of the first process are shown in FIG. 10(A). The first process is executed when the control circuit 222 detects the power ON request of the printer 200 or the replacement request of any of the ink cartridges 111 through 116. The first process starts with reading the ID information from the respective detection storage modules 121 through 126 (step S134) and carries out anti-collision processing (step S136). The anti-collision processing is required to prevent interferences in the course of reading the ID information from the respective detection storage modules 121 through 126 for the first time. In the structure of the embodiment utilizing wireless communication, the receiver transmitter unit 230 maybe communicable with multiple detection storage modules. At the start of communication, the control circuit 222 has not gained yet the ID information of the respective detection storage modules 121 through 126 attached to the ink cartridges 111 through 116 mounted on the carriage 210. The anti-collision processing is thus required to prevent interferences at this moment. The anti-collision processing is a known technique and is thus not described here in detail. The receiver transmitter unit 230 outputs a specific piece of the ID information. Only a detection storage module having ID information identical with the specific piece of ID information responds to the receiver transmitter unit 230, while the other detection storage modules fall into a sleep mode. The control circuit 222 of the printer 200 accordingly identifies the ID information of the detection storage module of the ink cartridge, which is located in the communicable range, and establishes communication with only the detection storage module having the identical ID information.

On conclusion of the anti-collision processing, the control circuit 222 causes the data analyzer 163 to read the ID information from the respective detection storage modules 121 through 126 (step S138). This concludes the first process.

Figure 10B:
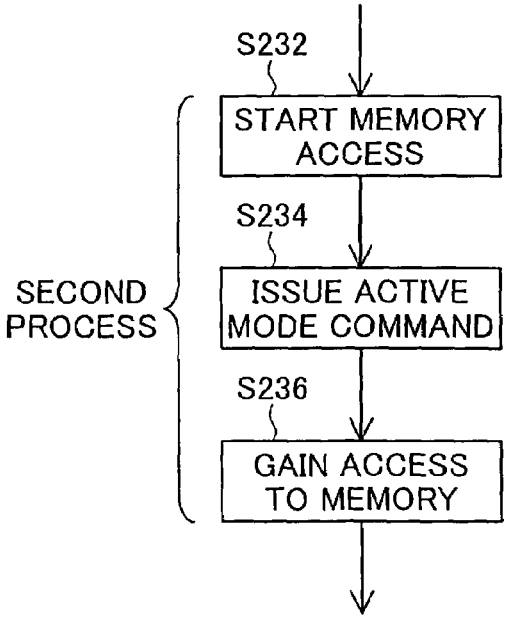

In the second process, the control circuit 222 gains access to the memory. As shown in FIG. 10(B), the control circuit 222 first initiates a memory access (step S232) and issues an active mode command to each of the detection storage modules 121 through 126 (step S234) The active mode command is output together with the ID information to each of the detection storage modules 121 through 126. The data analyzer 163 included in each of the detection storage modules 121 through 126 compares the received ID information with the ID information stored in the detection storage module and transmits a response signal ACK showing ready for an access to the control circuit 222 only when the received ID information is identical with the stored ID information.

The control circuit 222 receives the response signal ACK from each of the detection storage modules 121 through 126 in response to the output active mode command and gains an actual memory access to each of the detection storage modules 121 through 126 (step S236). The memory access is implemented either to write data into the EEPROM 166 or to read the existing data from the EEPROM 166. In either case, the EEPROM controller 165 gains access to a memory address specified by the control circuit 222. The EEPROM controller 165 receives the specified address and selection of either a reading operation or a writing operation and reads data from or writes data into the specified address in the EEPROM 166. On completion of the access to the EEPROM 166, the EEPROM controller 165 sends a response signal ACK representing completion of the access and the address actually accessed to the control circuit 222 via the data analyzer 163. This terminates the second process and completes writing the information with regard to the remaining quantity of ink into each of the detection storage modules 121 through 126.

Figure 10C:
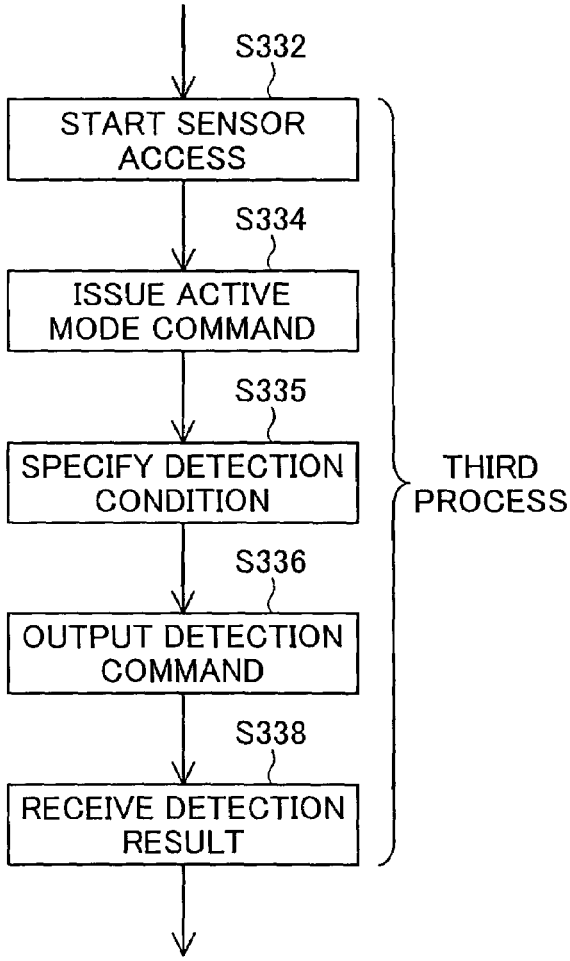

In the third process, the control circuit 222 gains access to the sensor module 137. As shown in FIG. 10(C), the control circuit 222 first initiates an access to the sensor module 137 (step S332) and issues an active mode command (step S334), as in the case of the memory access Among the detection storage modules 121 through 126 of the ink cartridges 111 through 116 that have received the active mode command, the detection storage module of the ink cartridge having the ID information identical with the ID information received with the active mode command sends back a response signal ACK showing ready for an access to accept the subsequent processing.

When any of the detection storage modules 121 through 126 of the ink cartridge is activated in response to the active mode command, the control circuit 222 transmits specification of a detection condition DN to the activated detection storage module (step S335). When the activated detection storage module receives the data specifying the detection condition DN and sends back a response signal ACK, the control circuit 222 outputs a detection command DC (step S336). The sensor module 137 included in the activated detection storage module receives the detection command DC, detects the remaining quantity of ink, and sends back the result of detection. The control circuit 222 receives the result of detection (step S338) and terminates the third process.

Any of the first through the third processes is carried out, while the carriage 210 with the six ink cartridges 111 through 116 is conveyed at the preset velocity V. This arrangement does not require the repetitive processing of positioning one ink cartridge, establishing communication, conveying the carriage 210, positioning an adjoining ink cartridge, and establishing communication. In the structure of this embodiment, the control circuit 222 sequentially establishes wireless communication with multiple ink cartridges and transmits required data (for example, ID information data to be written into the memory, or data of the detection result from the sensor module 137) to and from the respective ink cartridges within a short time period.

In the structure of the above embodiment, the stepping motor 223, which moves the carriage 210 for printing, is utilized for conveyance of the carriage 210 for the purpose of communication. No additional hardware is thus required for conveyance in communication. No especially high accuracy of positioning is required at the stop position of the carriage 210, prior to the conveyance. The stop position of the carriage 210 may be determined by taking into account the expected accuracy of positioning. This remarkably simplifies the positioning control of the stop position of the carriage 210.

The embodiment discussed above is to be considered in all aspects as illustrative and not restrictive. There may be many modifications, changes, and alterations without departing from the scope or spirit of the main characteristics of the present invention. For example, each of the detection storage modules 121 through 126 may be located on the bottom face or the top face of each ink cartridge. Location on the top face enhances the degree of freedom in arrangement of the receiver transmitter unit 230 and simplifies the whole system configuration. In the structure of the embodiment, the detection storage module mounted on the ink cartridge is subjected to both the detection by the sensor and the storage into the memory by wireless communication. The technique of the invention is also applicable to the ink cartridges having only the function of data transmission to and from the memory or the function of detection by the sensor. The structure of the above embodiment uses the six ink cartridges containing the six color inks (cyan, magenta, yellow, black, light cyan, and light magenta). The technique of the invention may be applied to only four ink cartridges containing four color inks other than the light inks or to any number of ink cartridges.

In the structure of the embodiment, the carriage 210 with the ink cartridges mounted thereon is conveyed. In one modified structure, the part corresponding to the receiver transmitter unit 230 may alternatively be conveyed, while the ink cartridges are fixed at the stationary position. The procedure of the above embodiment establishes wireless communication out of the moving range of the carriage 210 for printing. Wireless communication may otherwise be established during conveyance of the carriage 210 for printing. In such modifications, a high moving velocity Vp of the carriage 210 for printing may cause an insufficient communication time with each of the ink cartridges. A CPU is additionally mounted on the detection storage module of the ink cartridge to heighten the processing speed and thereby enable transmission of required data within a short time period. Another possible measure determines the pitch of the ink cartridges to ensure the sufficient communication time.

What is claimed is:

1. A recording apparatus comprising multiple cartridges, which contain recording materials therein, and an apparatus communication module that establishes wireless communication with each of said multiple cartridges, each of said multiple cartridges mounting a cartridge communication module, which establishes wireless communication with said apparatus communication module and possesses intrinsic information for identification of each of said multiple cartridges in wireless communication, said recording apparatus comprising:

a transportation module that is capable of collectively transporting said multiple cartridges and sequentially makes said cartridge communication modules mounted on said multiple cartridges approach to and pass by an antenna, which is provided for the wireless communication; and an access module that, when said cartridge communication module mounted on any one of said multiple cartridges enters a communicable range of said apparatus communication module via the antenna and establishes communication with said apparatus communication module, identifies the one of said multiple cartridges based on the intrinsic information possessed by the one of said multiple cartridges and transmits predetermined data to or from said identified cartridge;

wherein said transportation module transports said multiple cartridges at a specific moving velocity, which is set corresponding to an interval between each adjoining pair of said multiple cartridges to ensure a time period required for identification of each of said multiple cartridges and a time period required for transmission of the predetermined data.

2. A recording apparatus in accordance with claim 1, wherein said transportation module comprises a carriage with said multiple cartridges mounted thereon, and a conveyance sub-module that conveys said carriage for recording on a recording medium with the recording materials, said conveyance sub-module sequentially making said cartridge communication modules mounted on said multiple cartridges approach to and pass by the antenna.

3. A recording apparatus in accordance with claim 2, wherein said conveyance sub-module sequentially makes said cartridge communication modules mounted on said multiple cartridges approach to and pass by the antenna out of a recording range onto the recording medium.

4. A recording apparatus in accordance with claim 2, wherein said conveyance sub-module sequentially makes said cartridge communication modules mounted on said multiple cartridges approach to and pass by the antenna in a recording range onto the recording medium.

5. A recording apparatus in accordance with any one of claims 2 through 1, wherein said cartridge communication module included in each of said multiple cartridges utilizes electromagnetic induction for transmission of the predetermined data and receives at least part of electric power consumed by said cartridge.

6. A recording apparatus in accordance with claim 1, wherein each of said multiple cartridges has an ink chamber containing one of multiple color inks as the recording material.

7. A recording apparatus in accordance with claim 1, wherein the predetermined data transmitted to and from said access module comprise data regarding the recording materials contained in said multiple cartridges.

* * * * *